US011145964B1

(12) United States Patent
Hellinger et al.

(10) Patent No.: US 11,145,964 B1
(45) Date of Patent: Oct. 12, 2021

(54) RADAR SENSOR COVER ARRANGEMENT

(71) Applicant: Robert Bosch GmbH, Stuttgart (DE)

(72) Inventors: Raphael Hellinger, Novi, MI (US); Andreas Mehs, Walled Lake, MI (US); Andreas M. Pietsch, Baden-Württemberg (DE); Dániel Ádil Mazroa, Szeged (HU); Klaus Baur, Mietingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/848,017

(22) Filed: Apr. 14, 2020

(51) Int. Cl.
*H01Q 1/42* (2006.01)

(52) U.S. Cl.
CPC ..... *H01Q 1/42* (2013.01)

(58) Field of Classification Search
CPC ..... H01Q 1/42
USPC ..... 343/872
See application file for complete search history.

(56) References Cited

U.S. PATENT DOCUMENTS

| | | | | |
|---|---|---|---|---|
| 4,148,039 | A | 4/1979 | Lunden | |
| 4,179,699 | A | 12/1979 | Lunden | |
| 4,506,269 | A | 3/1985 | Greene | |
| 4,783,666 | A | 11/1988 | Ast et al. | |
| 4,980,696 | A | 12/1990 | Stone et al. | |
| 5,323,170 | A | 6/1994 | Lang | |
| 5,662,293 | A | 9/1997 | Hower et al. | |
| 6,028,565 | A | 2/2000 | Mackenzie et al. | |
| 8,605,001 | B2 | 12/2013 | Yamamoto et al. | |
| 8,712,506 | B2 | 4/2014 | Courtney et al. | |
| 8,760,359 | B2 | 6/2014 | Sato et al. | |
| 8,917,220 | B2 | 12/2014 | Ziolkowski et al. | |
| 9,099,782 | B2 | 8/2015 | Ziolkowski | |
| 9,876,279 | B2 | 1/2018 | Crouch et al. | |
| 2008/0252552 | A1* | 10/2008 | Goebel | H01Q 1/246 343/872 |
| 2017/0008251 | A1 | 1/2017 | Pruett et al. | |
| 2017/0346176 | A1 | 11/2017 | Linn et al. | |

* cited by examiner

*Primary Examiner* — Peguy Jean Pierre

(74) *Attorney, Agent, or Firm* — Michael Best & Friedrich LLP

(57) ABSTRACT

A cover for a radar sensor, the cover comprising a plastic body and a foam material. The plastic body has a first surface and a second surface facing in an opposite direction to the first surface. The second surface includes a plurality of spaced-apart recesses formed in the second surface. The foam material at least partly contacts the second surface to prevent debris of water from entering the recesses.

20 Claims, 5 Drawing Sheets

RADAR SENSOR COVER ARRANGEMENT

BACKGROUND

The present invention relates to radar sensors, and more specifically to covers or fascia for radar sensors.

SUMMARY

In one embodiment, the invention provides a cover for a radar sensor. The cover comprises a plastic body having a first surface and a second surface facing in an opposite direction to the first surface. The second surface includes a plurality of spaced-apart recesses formed therein. The cover further comprises a foam material at least partly contacting the second surface to prevent debris or water from entering the recesses.

In another embodiment the invention provides a cover for a radar sensor. The cover comprises a plastic body having a first surface and a second surface facing in an opposite direction to the first surface. The second surface includes a plurality of spaced-apart recesses formed therein. The cover further comprises a foam material at least partly contacting the second surface to prevent debris or water from entering the recesses. The foam material is a closed-cell foam with a dielectric constant ranging from 1.0 to 1.2.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
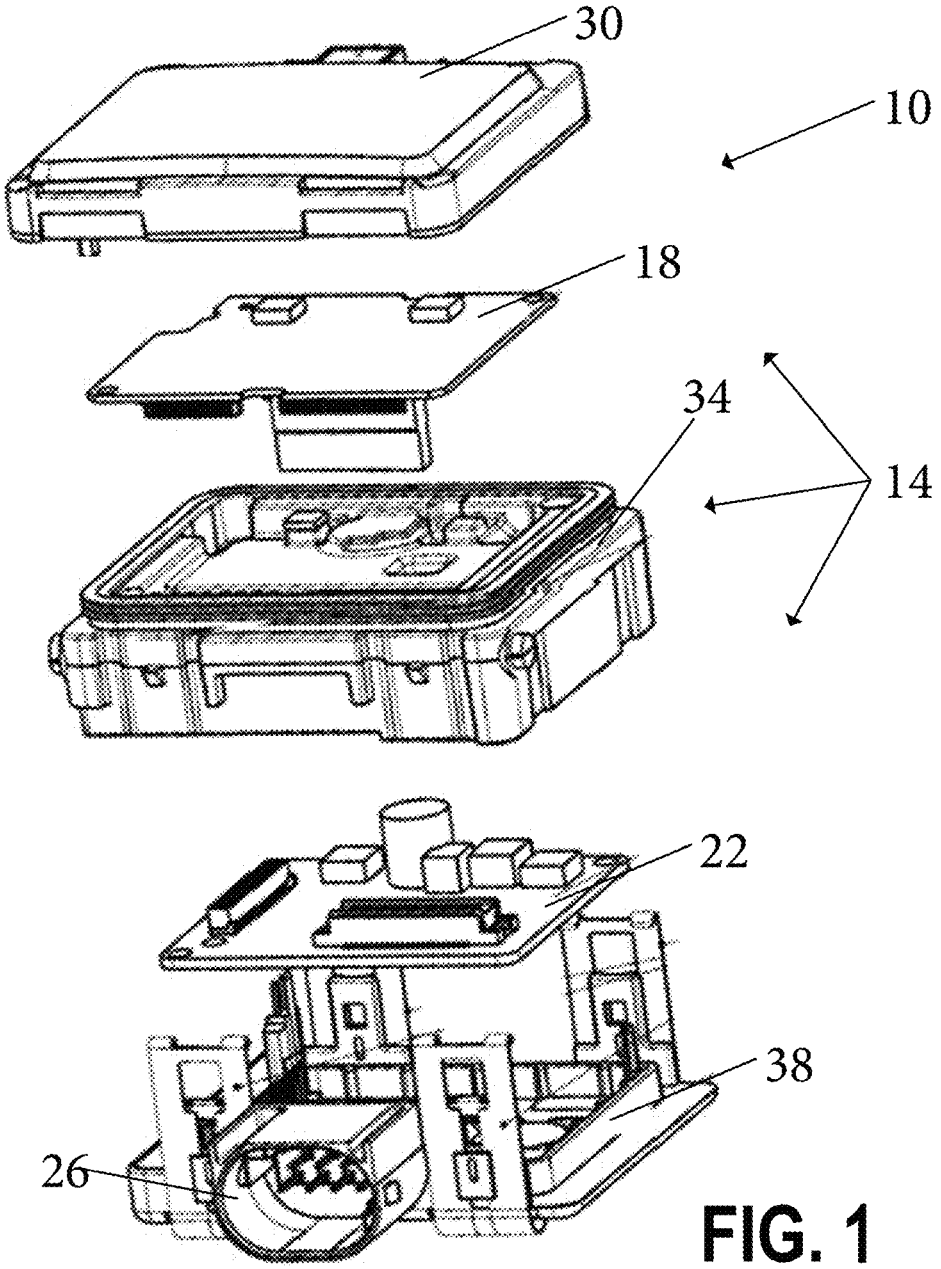
FIG. 1 is an exploded view of a radar unit.

With reference to FIG. 1, a radar sensor or unit 10 includes a housing 14 for enclosing various radar sensor components, including a first printed circuit board (PCB) 18 for the radar and a second printed circuit board 22 for power control. One of the first and second circuit boards 18, 22 may include electrical components such as an antenna and a receiver (not shown). The second printed circuit board 22 functions as an interface between the first printed circuit board 18 and a vehicle connector port 26. The vehicle connector port 26 is connected to an engine control unit (not shown) for power and data transfer between the radar sensor 10 and a vehicle.

The radar sensor housing 14 includes a first or front cover (first housing portion) 30, a sub-carrier (third housing portion) 34, and a second or rear cover (second housing portion) 38. Regardless of mounting orientation within the vehicle (i.e., facing the front of the vehicle, the rear of the vehicle, a side of the vehicle, etc.), the front cover 30 is the portion of the housing 14 through which the radar waves are primarily directed from the radar PCB 18 and through which returning radar waves reach the radar PCB 18. For example, if the radar sensor housing 14 is positioned to assist with forward collision detection or adaptive cruise control in a vehicle, the front cover 30 is positioned between the radar PCB 18 and the detected vehicle in front of the vehicle. If the radar sensor housing 14 is positioned to assist with rear cross traffic alert, the front cover 30 is positioned between the radar PCB 18 and the detected vehicle behind the vehicle.

The front cover 30 extends across the entirety of the radar PCB 18 and, as shown, at least partially encapsulates the radar PCB 18. The radar waves generated by the radar unit 10 are directed from the radar PCB 18 towards the front cover 30 and are emitted through the front cover 30. As shown, the front cover 30 directly supports the radar PCB 18. The front cover is attachable to the sub-carrier 34 by fasteners (e.g., threaded fasteners such as screws, etc.), a snap-engagement feature (such as the spring clips or an alternative feature), or both.

The rear cover 38 is located opposite the front cover 30. The radar waves generated by the radar unit 10 are directed from the radar PCB 18 away from the rear cover 38. The rear cover 38 is attached to or is integrally molded with the vehicle connector port 26. The rear cover 38 at least partially encapsulates the power PCB 22, and in the illustrated embodiment, supports the power PCB 22.

Figure 2:
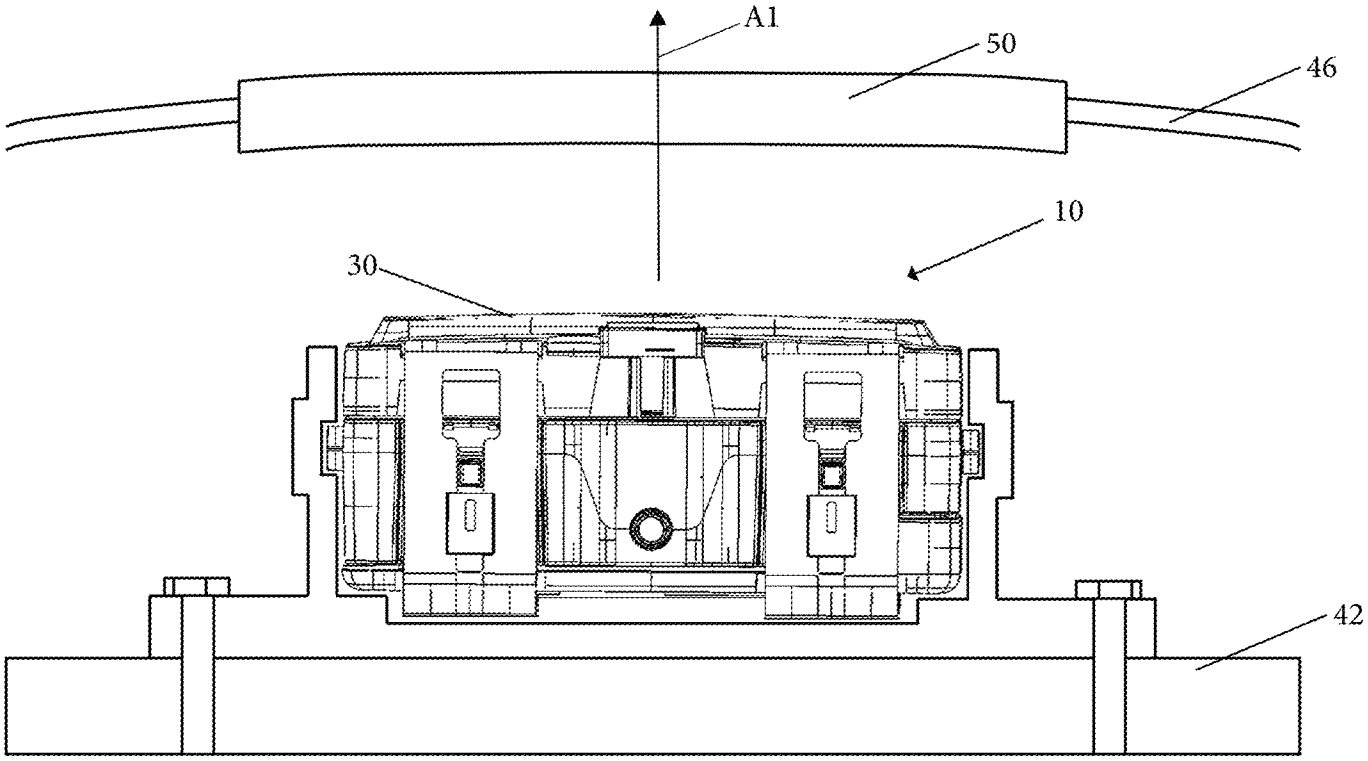
FIG. 2 is a top view of a mounted radar unit relative to a vehicle body panel according to one aspect of the invention.

Referring now to the embodiment of FIG. 2, in use, the radar unit 10 is mounted to a bracket structural member 42 (e.g., bumper beam) of the vehicle behind a body panel 46 (e.g., a panel, a grill, a fascia, etc.). In other embodiments, the radar unit 10 may be mounted directed to the body panel 46. A radome cover 50 is mounted in the body panel 46 such that waves emitted by the radar unit 10 pass through the front cover 30 and the radome cover 50, as indicated by arrow A1. In this embodiment, the radome cover 50 is not included in the radar housing 14, is spaced apart from the radar unit 10, and is located between the radar unit 10 and the surroundings of the vehicle. More specifically, the radome cover 50 is located between the radar PCB 18 and the front cover 30 of the radar unit 10 and the exterior of the vehicle. Stated another way, when the radar unit 10 emits radar waves, the radar waves pass through the front cover 30, and through the radome cover 50 mounted in the body panel 46, and to the exterior of the vehicle. The front cover 30 and the radome cover 50 provide clear transmission of radar waves therethrough.

Figure 3:
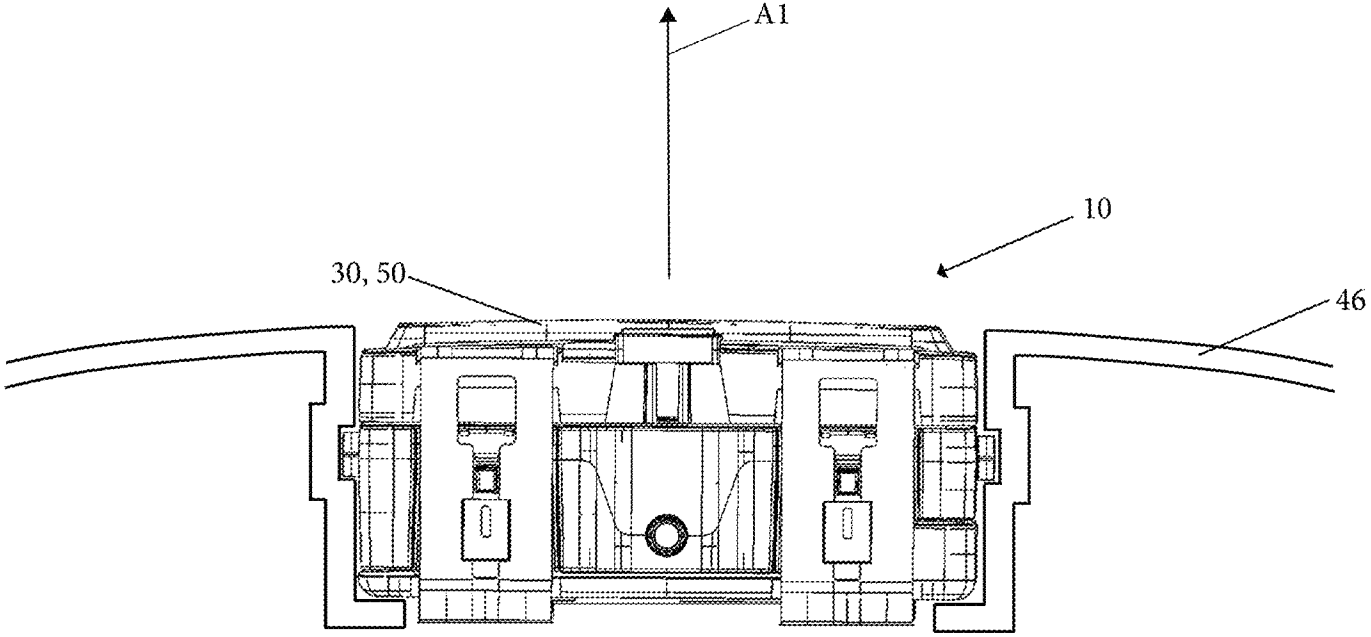
FIG. 3 is a top view of a mounted radar unit relative to a vehicle body panel according to another aspect of the invention.

Referring now to the embodiment of FIG. 3, in use, the radar unit 10 is mounted to the body panel 46. In other embodiments, the radar unit 10 may be mounted to a bracket structural member. In this embodiment, the radome cover 50 is integrally formed with the front cover 30 such that the front cover 30 is a radome cover 50. The radome cover 30 is not spaced apart from the radar unit 10, but is still located between the radar unit 10 and the surroundings of the vehicle. The radome cover 50 is still located between radar PCB 18 of the radar unit 10 and the exterior of the vehicle. Regardless of whether the radome cover 50 is mounted in the body panel 46 or is integrally formed with the front cover 30, the radar waves directed from the radar PCB 18 and the waves returning to reach the radar PCB 18 pass through the radome cover 50.

Figure 4:
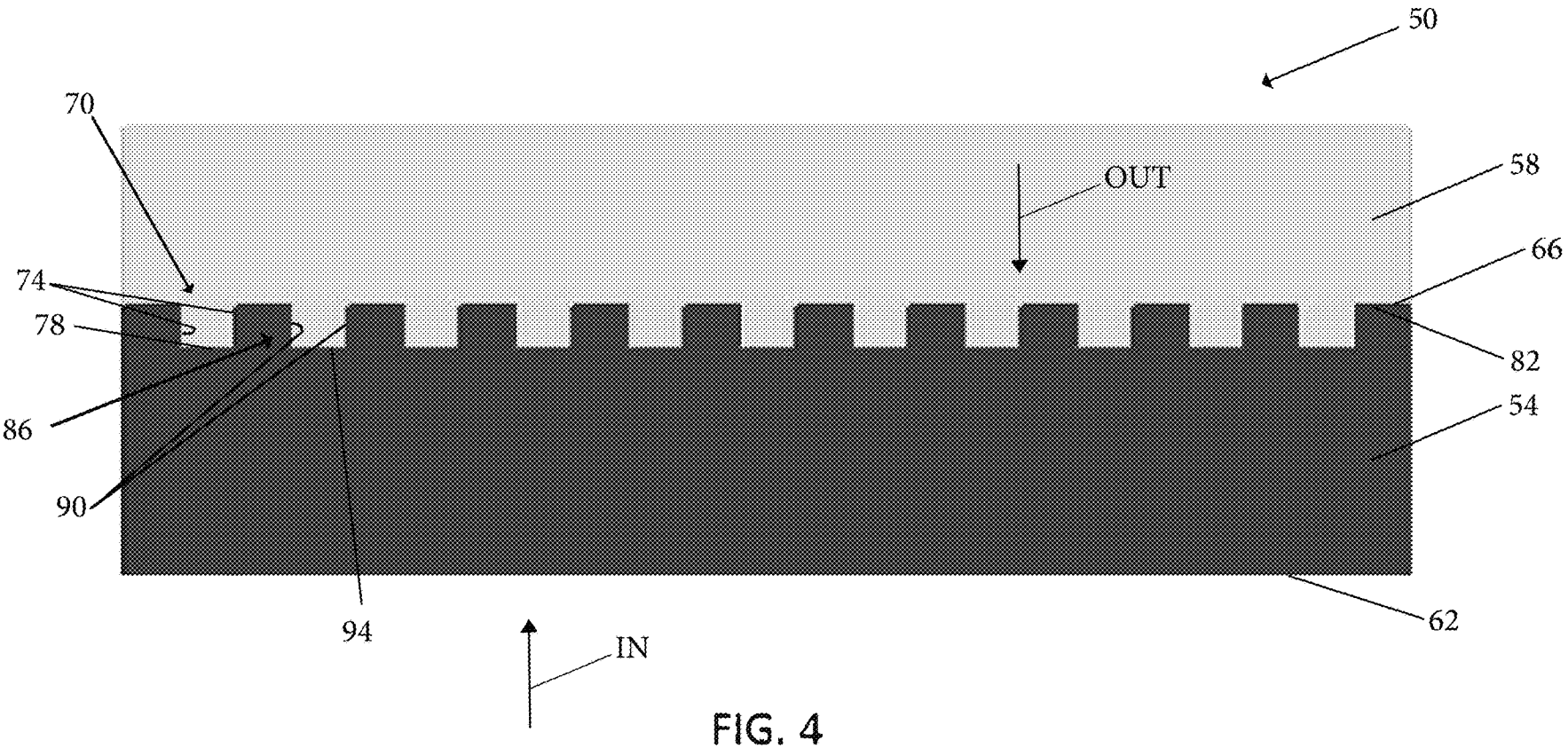
FIG. 4 is a section view of a radome cover for a radar unit according to one aspect of the invention.
Figure 5:
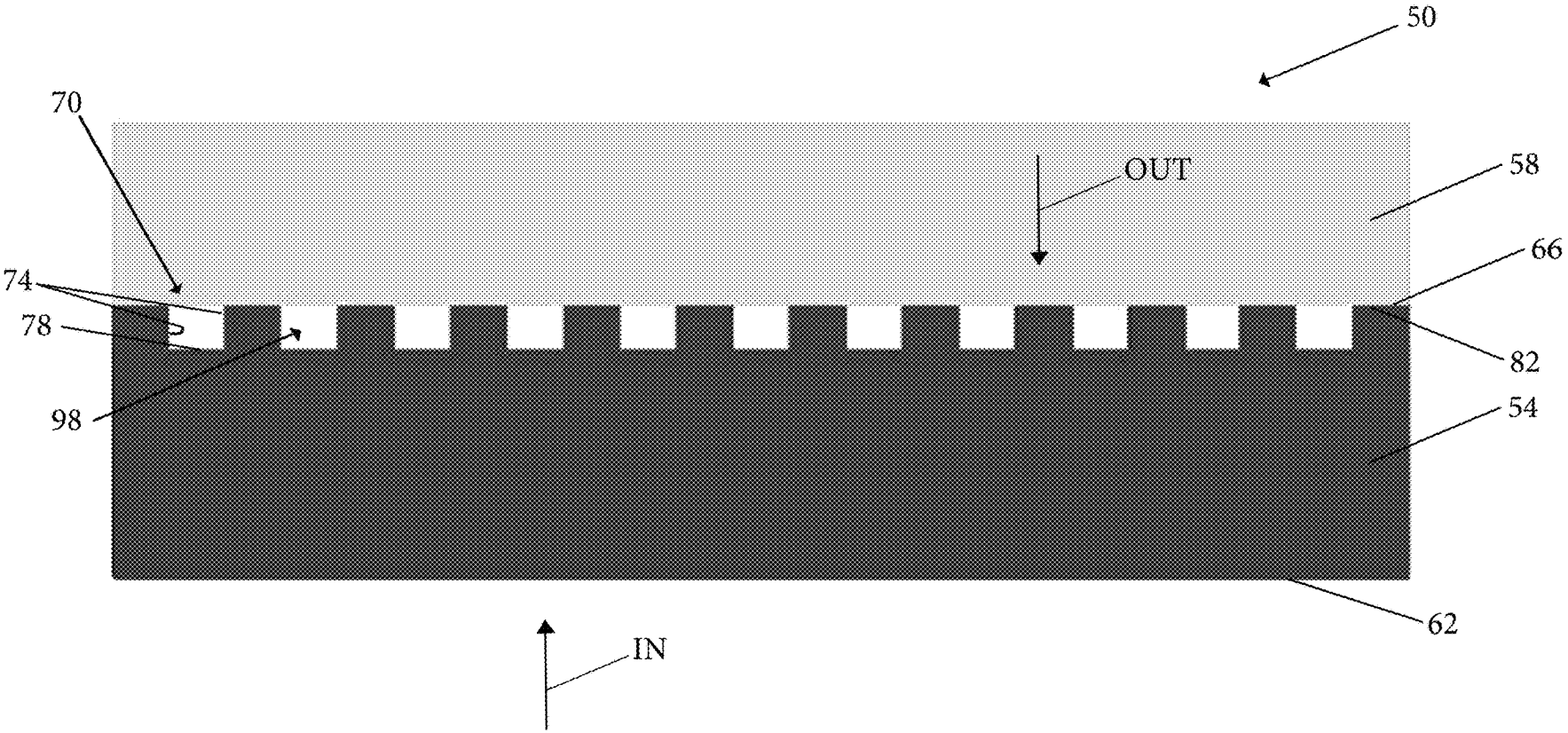
FIG. 5 is a section view of a radome cover for a radar unit according to another aspect of the invention.

FIGS. 4 and 5 show detailed section views of embodiments of the radome cover 50. The radome cover 50 includes a plastic body 54 (e.g., polycarbonate) and a foam backing material 58 that are engaged to form the radome cover 50. The plastic body 54 has a first or front surface 62 and a second or rear surface 66 facing generally in the opposite direction of the first surface 62. The first surface 62 is configured to initially receive radar waves returning to the radar PCB 18 (see arrow labeled IN) and the second surface 66 is configured to initially receive radar waves emitted by the radar PCB 18 (see arrow labeled OUT). The second surface 66 includes or defines a plurality of spaced-apart recesses 70 to work as a transformer to facilitate transmission of radar waves through the plastic body 54. The recesses 70 extend from a rearward-most part of the second surface 66 toward the first surface 62 such that the second surface 66 includes a plurality of side walls 74 and a plurality of bottom walls 78 defined by the recesses 70. In the illustrated embodiment, the plurality of spaced-apart recesses 70 are formed in a repeating square-shaped pattern in the second surface 66 to facilitate wave transmission through the plastic body 54. The recesses 70 act similarly to a quarter-Lambda transformer, providing optimum cancellations of reflections of the radar waves transmitted through the radome cover 50. In other embodiments, the spaced-apart recesses 70 may be formed by a sinusoidal wave pattern, or any other geometrical configuration or pattern with spaced-apart recesses 70 that facilitates wave transmission through the plastic body 54.

The foam backing material 58 includes a contact surface 82 that contacts the second surface 66 of the plastic body 54 when the foam material 58 and the plastic body 54 are engaged to form the radome cover 50. When the contact surface 82 of the foam material 58 contacts the second surface 66 of the plastic body 54 to form the radome cover 50, debris and water are prevented from entering and gathering in the recesses 70. Such water and debris would be detrimental to the transmission of radar waves through the plastic body 54. To properly seal the recesses 70 from a surrounding environment, the foam material 58 is attached to the plastic body 54 via an adhesive or by 2*k* casting. The foam material 58 is preferably a closed-cell foam so that water cannot permeate through the foam material 58 to enter the recesses 70. To allow for proper transmission of radar waves through the foam material 58, the foam material 58 has a very low dielectric constant. The dielectric constant may be between 1.0 and 1.2 and is preferably <1.05. Similarly, the foam material 58 should have a thickness that facilitates proper transmission of radar waves through the radome cover 50 while still operating to keep water and debris out of the recesses 70. The thickness may between 0.5 mm and 3 mm, and is preferably 1 mm.

With continued reference to the embodiment of FIG. 4, the contact surface 82 of the foam material 58 contacts the second surface 66 of the plastic body 54 such that the foam material 58 completely fills the recesses 70. Specifically, the foam material 58 includes a plurality of projections 86 sized and configured to match the recesses 70, such that the contact surface 82 includes a plurality of edge walls 90 and top walls 94 defined by the projections 86. When the contact surface 82 contacts the second surface 66 to form the radome cover 50, the edge walls 90 of the contact surface 82 engage the side walls 74 of the second surface 66, and the top walls 94 of the contact surface 82 engage the bottom walls 78 of the second surface 66. Because the contact surface 82 and the second surface 66 seal the recesses 70 from the surrounding environment, and because the recesses 70 are completely filled by the foam material 58, no debris or water can enter the recesses 70. In other embodiments, the projections 86 may be of other shapes and sizes such that the edge walls 90 of the projections 86 may not engage an entirety of, or any portion of, the side walls 74 of the recesses 70, and/or the top walls 94 of the projections 86 may not engage an entirety of, or any portion of, the bottom walls 78 of the recesses 70. In these embodiments, the foam material 58 may only partially fill the recesses 70 and the contact surface 82 of the foam material 58 may only partly contact the second surface 66 of the plastic body 54. However, the recesses 70 are still sealed from the surrounding environment to prevent water and debris from entering the recesses 70.

With reference now to the embodiment of FIG. 5, the generally planar contact surface 82 of the foam material 58 contacts only the rearward-most portion of the second surface 66 of the plastic body 54 such that the foam material does not extend into or fill the recesses 70 at all. In this embodiment, the foam material 58 does not include projections 86, and instead merely covers the recesses 70 to create cavities 98 when the contact surface 82 contacts the second surface 66 to form the radome cover 50. In the illustrated embodiment, the cavities 98 are air gaps (or evacuated gaps) between the contact surface 82 of the foam material 58 and the bottom walls 78 of the recesses 70. Although the recesses 70 are not filled with the foam material 58 and although the contact surface 82 of the foam material 58 only partly contacts the second surface 66 of the plastic body 54, the recesses 70 are still sealed from the surrounding environment to prevent water and debris from entering the recesses 70.

Various features and advantages of the invention are set forth in the following claims.

What is claimed is:

1. A cover for a radar sensor, the cover comprising:

a plastic body having a first surface and a second surface facing in an opposite direction to the first surface, the second surface including a plurality of spaced-apart recesses formed therein; and a foam material separate and distinct from the plastic body and at least partly contacting the second surface to prevent debris or water from entering the recesses.

2. The cover of claim 1, wherein the foam material covers the recesses and creates cavities at the recesses between the second surface and the foam material.

3. The cover of claim 1, wherein the foam material at least partially fills the recesses.

4. The cover of claim 3, wherein the foam material completely fills the recesses.

5. The cover of claim 1, wherein the plurality of recesses form a repeating square-shaped pattern.

6. A radar sensor unit comprising:

the cover of claim 1; and a radar printed circuit board configured to emit radar waves through the cover, wherein the foam material is located between the plastic body and the radar printed circuit board.

7. The cover of claim 1, wherein the foam material is a closed-cell foam.

8. The cover of claim 1, wherein the foam material has a dielectric constant ranging from 1.0 to 1.2.

9. The cover of claim 1, wherein the foam material is attached to the plastic body by adhesive or 2k casting.

10. The cover of claim 1, wherein the foam material is press-fit into the plurality of recesses.

11. The cover of claim 1, wherein the foam material has a thickness ranging from 0.5 mm to 3 mm.

12. The cover of claim 1, wherein the cover is part of a radar sensor unit, the cover defining a front cover of a housing of the radar sensor unit.

13. The cover of claim 1, wherein the cover defines a radome spaced apart from a radar sensor unit.

14. A cover for a radar sensor, the cover comprising:

a plastic body having a first surface and a second surface facing in an opposite direction to the first surface, the second surface including a plurality of spaced-apart recesses formed therein; and a foam material separate and distinct from the plastic body and at least partly contacting the second surface to prevent debris or water from entering the recesses, the foam material being a closed-cell foam with a dielectric constant ranging from 1.0 to 1.2.

15. The cover of claim 14, wherein the foam material covers the recesses and creates cavities at the recesses between the second surface and the foam material.

16. The cover of claim 14, wherein the foam material at least partially fills the recesses.

17. The cover of claim 14, wherein the foam material completely fills the recesses.

18. The cover of claim 14, wherein the plurality of recesses form a repeating square-shaped pattern.

19. The cover of claim 14, wherein the foam material is attached to the plastic body by adhesive or 2k casting.

20. The cover of claim 14, wherein the foam material has a thickness ranging from 0.5 mm to 3 mm.

* * * * *